United States Patent [19]

Schneider

[11] 4,305,110

[45] Dec. 8, 1981

[54] MUD SEPARATOR VALVE APPARATUS

[75] Inventor: Stephen J. Schneider, Houston, Tex.

[73] Assignee: Milchem Incorporated, Houston, Tex.

[21] Appl. No.: 167,515

[22] Filed: Jul. 11, 1980

[51] Int. Cl.[3] ..... B08B 3/00

[52] U.S. Cl. ..... 361/189; 361/160; 175/38; 175/206; 209/270

[58] Field of Search ..... 361/160, 189, 191; 175/66, 207, 206

[56] References Cited

U.S. PATENT DOCUMENTS

| | | | |
|---|---|---|---|
| 3,400,819 | 9/1968 | Burdyn | 175/66 |
| 3,964,557 | 6/1976 | Juvkam-Wold | 175/66 |
| 4,090,523 | 5/1978 | Kelly, Jr. et al. | 175/38 |

*Primary Examiner*—J. D. Miller

*Assistant Examiner*—L. C. Schroeder

*Attorney, Agent, or Firm*—William C. Norvell, Jr.

[57] ABSTRACT

An automatic cleaning system is provided for a mud separator apparatus. Water and mud inputs to a mud pump feeding the separator are respectively controlled by two butterfly valves ganged for cooperation, and operated by a single valve actuator motor. When the mud separator is shut off, a time delay relay is actuated which keeps the mud separator rotor motor on line during a predetermined flush cycle. The valve actuator opens the water valve, and closes the mud valve, permitting the separator to be flushed with water. Activating the start button returns the valve actuator to the position in which the mud valve is open and the water valve is closed, thereby returning the apparatus to the mud separation cycle.

4 Claims, 2 Drawing Figures

MUD SEPARATOR VALVE APPARATUS

BACKGROUND OF THE INVENTION

1. FIELD OF THE INVENTION

The present invention relates to a cleaning system for a mud separator, used in conjunction with, for example, the drilling or workover of a subterranean well.

2. DESCRIPTION OF THE PRIOR ART

During the drilling of a subterranean well, drilling fluid, or mud, is circulated into and throughout the well. The mud serves to cool the bit and to carry cuttings away from the bottom of the bore hole. Typically, a drilling mud comprises a viscous suspension of barite. As the mud circulates, it becomes contaminated with gases, cuttings, and other particulates. It is therefore necessary to treat the mud chemically and mechanically before recirculating it to the bore hole.

For such mechanical treatment, common filters or centrifuges have, by themselves, proved inadequate. The high viscosity tendency to gel which are desirable qualities in a drilling fluid or mud militate against normal centrifugal separation.

A separator as disclosed in U.S. Pat. No. 3,400,819 to Burdyn has proved effective for mechanical treatment of such mud. In general, such a mud separator comprises a substantially cylindrical, perforated mud barrel which is rotated within a pressure tight chamber. A fluid pressure differential is created in the separator in a direction to oppose the centrifugal action caused by the rotating mud barrel. Mud is introduced within the pressure tight chamber. A portion of the mud is accelerated by the rotating mud barrel, and is thus subject to both centrifugal action and a pressure differential tending to effect flow in an opposite direction. By varying the speed of rotation, rate of mud flow, and other factors, the degree of particle separation may be controlled. The mud separator is fed by a mud pump. The pump has inlet valves to control the flow of water and mud into the pump. Depending on their position, the mud pump will circulate mud to the separator for processing, or water for dilution or flushing. When a mud separator is shut down for whatever reason, the barite will settle out of the mud suspension, unless the separator is properly flushed with water. This deposit of barite will create an inbalance in the mud barrel. Subsequent operation of the unbalanced mud barrel will greatly reduce the life of its bearings and associated rotary sealing units.

Heretofore, a major concern with such mud separators has been maintenance cost due to the short life of seals, bearings and associated components. When the separator is manually shut down, manual cleaning may be neglected. In case of an overload on the motor, a current sensing relay trips the motor off circuit. In either case, settling of barite and consequent inbalance in the rotating mud barrel have occured. Accordingly, there is a need for an automatic cleaning system which will close the mud valve and open the water valve to the mud pump, thus effecting a flushing cycle, each time the mud separator is shut off, or when the mud barrel begins to plug up, thus overloading the drive motor.

SUMMARY OF THE INVENTION

A mud separator comprises a mud pump having water and mud inlets, and a particle segregator having a rotating mud barrel within a pressure tight chamber. Proper maintenance requires that the mud barrel by cleaned with water each time the mud separator is shut down. The invention provides a cleaning system which actuates the water and mud valves to the mud pump, and maintains power to the motor driving the separator for a predetermined interval each time the mud separator is shut down, thereby effecting an automatic flushing cycle.

The two butterfly valves which respectively control the water and mud inlets to the mud pump are ganged to a common shaft, 180° out of phase, that is, one valve is completely closed when the other is completely open. The two cooperating butterfly valves are operated by a single valve actuator driven by a low current motor.

When the separator is operating in the mud separation cycle a main motor drives the rotating mud barrel, the mud valve to the mud pump is open, and the water valve is closed. Operating a stop switch activates a time relay which maintains power to the motor during a predetermined interval. The stop switch deenergizes another auxiliary relay, thereby causing the valve actuator to open the water valve and close the mud valve. Thus as the mud barrel continues to operate during the timed delay, it is cleaned with water.

The main motor may also be shut off automatically, when a current sensing relay senses that the motor is drawing too much current, generally because the mud barrel is beginning to clog. This current sensing relay does not directly take the motor off line, but rather de-energizes the same auxiliary relay, thus beginning the cleaning cycle.

Whether the mud separator is shut down manually or automatically, the motor continues to operate during a timed delay cleaning cycle, during which water is pumped through the separator. At the end of the predetermined delay period, the delay relay contacts are released, de-energizing a main contact or relay, thereby shutting off the motor.

When the mud separator is to be restarted, a start button re-energizes the auxiliary relay, which energizes the timed delay relay, which in turn energizes the main contactor relay, thus putting the motor back on line. When the auxiliary relay is re-energized, the set of contacts for the valve actuator are closed, thereby causing the valve actuator to reopen the mud valve and close the water valve. The system will then be in the mud separation cycle, where it will continue to operate until the mud separator is shut down, and another automatic flush cycle begins.

DESCRIPTION OF THE PREFERRED EMBODIMENTS

Figure 1:
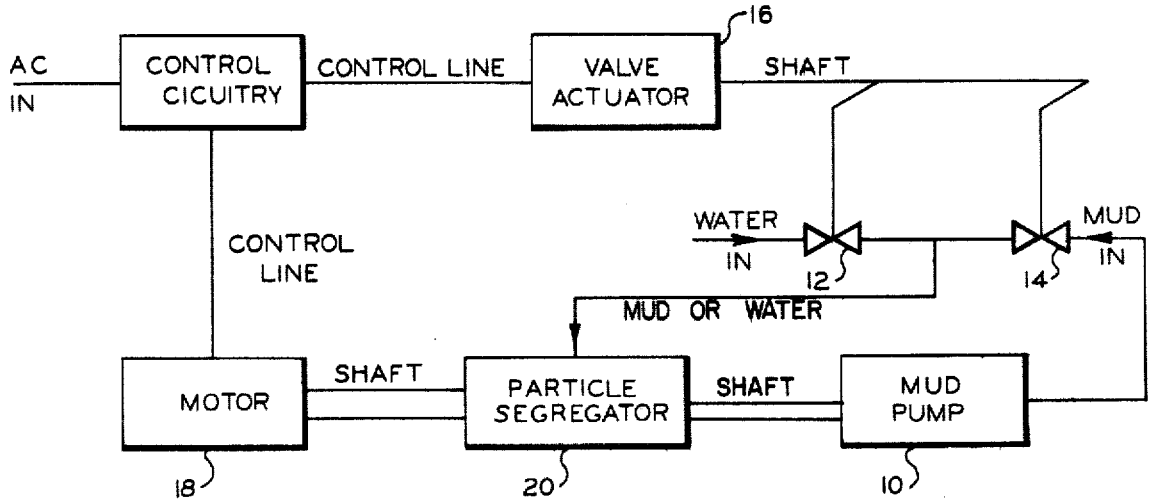
FIG. 1 is a schematic block diagram illustrating the relationship of the mud pump, inlet valves, valve actuator, and control circuitry.

Referring to FIG. 1, a mud pump 10 draws drilling mud from a tank (not shown) or other source and pumps it into a particle segregator 20 for mechanical treatment before recirculating the mud to the well bore. The particle segregator 20 includes a motor driven rotating mud barrel, which must be flushed with water after each use. The mud pump 10 has inlets for water and mud, which are respectively controlled by a water butterfly valve 12 and a mud butterfly valve 15. Although other types of valves could be employed, butterfly valves are preferred for their durability in the environment of the viscous mud suspension. The butterfly valves 12, 14 are ganged together, 180° out of phase, and operated by single valve actuator 16. The valve actuator 16 is of conventional design, and comprises a low current reversible motor, a gear reduction mechanism to operate the valves, and travel limit switches. A standard actuator such as the Raymond Control Systems MAR series is suitable.

When the mud separator is shut down, the control circuitry cycles the system through an automatic cleaning sequence. During the cleaning cycle, the motor 18 driving the mud barrel (not shown) within the particle segregator 20 remains on line. The valve actuator 16 closes the mud valve 14 and opens the water valve 12. Therefore, water is pumped through the mud barrel, flushing it of mud. The danger of barite precipitation from a mud residue in the barrel is thereby eliminated. At the end of a predetermined time delay, the motor 18 is shut off.

When the mud separator is restarted, the valve actuator 16 returns to is original position, opening the mud inlet valve 14, thereby permitting mud to be pumped to the particle segregator 20.

Figure 2:
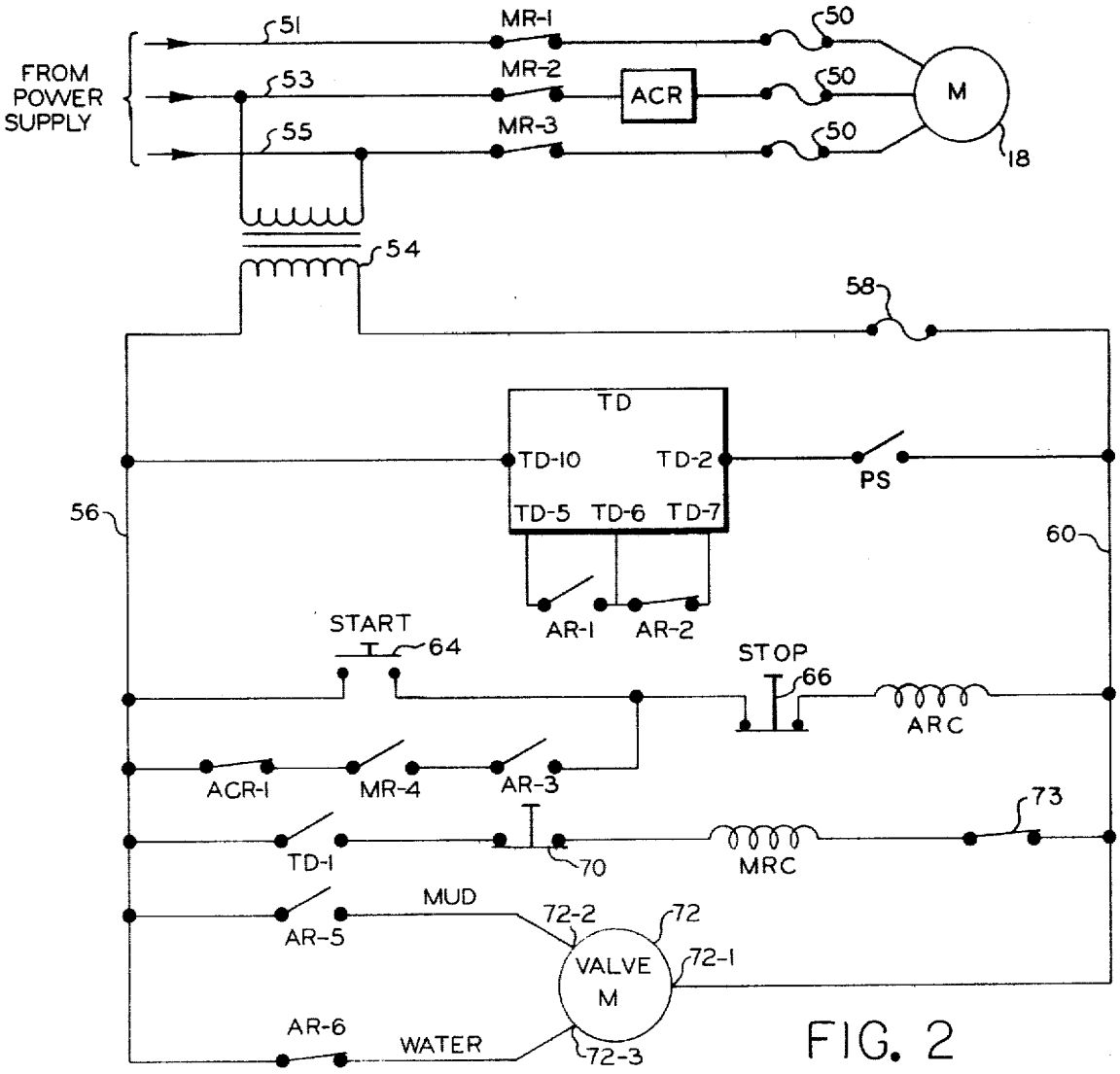
FIG. 2 is a schematic diagram of the control circuitry for effecting an automatic flush cycle of a mud separator.

Referring to FIG. 2, the control circuitry for the valve actuator 16 and the main motor 18 will be described. The control circuit comprises three relays and their associated contacts. A main contact relay has a main relay coil MRC and associated relay contacts MR-1, MR-2, MR-3, and MR-4. These main relay contacts are all open when the main relay coil MRC is de-energized.

An auxiliary relay comprises an auxiliary relay coil ARC and associated contacts AR-1, AR-2, AR-3, AR-5, and AR-6. When the auxiliary relay coil ARC is de-energized, auxiliary contacts AR-1, AR-3, and AR-5 are open and contacts AR-2 and AR-6 are closed.

A time delay relay TD includes contacts TD-1 which close when the time delay relay TD is energized, and remain closed for a preselected delay period after the relay TD is de-energized. The delay relay TD is preferably of the Potter and Brumfield CH series, and is connected for "delay on release" operation.

A water pressure switch is provided to prevent the drive motor from being energized if water is not available. This pressure switch will also de-energize the motor, if the water supply to the unit fails. A set of contact PS are closed when water pressure is above a predetermined amount, typically about 3 p.s.i.

The motor 18 which drives the mud barrel of the particle segregator 20 is powered by a three phase AC power supply (not illustrated). One motor terminal is connected in series through an overload protective unit 50 of a standard overload assembly and main relay contact MR-1 to line 51 from the power supply. Similarly, a second motor terminal is connected through an overload unit 50, and the main relay contacts MR-3 to line 55 from the power supply. The third motor terminal is connected in series through an overload unit 50, an anti-clogging relay ACR, and the contacts MR-2 to the line 53 from the power supply. The anti-clogging relay ACR is a standard current sensing relay such as the Allen Bradley Bulletin 809 relay, which will trip out when the motor 18 begins to draw current above a predetermined level.

A transformer 54 supplies power to the control circuitry. The primary coil of the transformer 54 is connected across power lines 53 and 55. The secondary of the transformer 54 is connected on one side to line 56, and on the other side through a fuse 58 to line 60. Terminal TD-10 of the time delay relay TD is connected to line 56 and terminal TD-2 is connected to line 60 through the contacts PS. Auxiliary relay contacts AR-1 are connected between terminals TD-5 and TD-6 of the time delay relay TD. Auxiliary relay contacts AR-2 are connected between relay terminals TD-6 and TD-7 of time delay relay TD. The coil of the relay TD is energized when contacts AR-1 are closed and contacts AR-2 are open.

The auxiliary relay coil ARC is connected between lines 56 and 60 in series with a normally opened, momentary contact start switch 74 and a normally closed, momentary release stop switch 66. A standard contact-maintaining circuit is connected across the start switch 64, and comprises a normally closed contact ARC-1 of the anti-clogging relay unit ACR, normally opened contacts MR-4 associated with the main relay coil MRC and normally open contacts AR-3 of the auxiliary relay ARC.

The main relay coil MRC is connected between lines 60 and 56 in series with normally closed contacts TD-1 of the time delay relay TD, an emergency stop switch 70, and contacts 73 of a standard overload assembly, associated with overload units 50.

One terminal 72-1 of the motor 72 of the valve actuator 16 is connected to line 60. A second terminal 72-2 of the valve motor 72 is connected in series through normally open contacts AR-5 of the auxiliary relay ARC to line 56. The third terminal 72-2 of valve motor 72 is connected in series through normally closed contacts AR-6 to line 56. When contacts AR-5 close, connecting terminals 72-2 and 72-1 across the power supply, the motor 72 operates mud valve 14 to its open position and water valve 12 to its closed position. Conversely, when contacts AR-6 are closed, the valve actuator motor 72 opens the water valve 12 and closes the mud valve 14.

The control circuitry having been described, its operation through a full cycle will now be explained, beginning with the circuit as illustrated in FIG. 2, with the relays de-energized and the motors off. Pressing the start button 64 energizes the auxiliary relay coil ARC by completing the circuit between coil ARC and the secondary terminals of the transformer 54. When the coil ARC is energized, contacts AR-1, AR-3 and AR-5 close, and contacts AR-2 and AR-6 open. The switching of contacts AR-1 and AR-2 energizes the coil of the time relay TD, which in turn causes contacts TD-1 to close, energizing the main relay coil MRC. When the main relay coil MRC is energized, contacts MR-1, MR-2, and MR-3 close, thereby bringing the motor 18 on line. Contacts MR-4 also close, thereby locking in the start button 64 so that when it is released, the auxiliary relay coil ARC remains energized. The closing of contacts AR-5 causes the valve actuator motor 72 to open the mud valve 14 and close the water valve 12 to the mud pump 10. In this mud separation position, mud flows through the valve 14, the pump 10, and into the particle segregator 20 and the mud barrel driven by the motor 18.

When it is desired to shut down the mud separator, pushing the stop button 66 will cause the apparatus to go to an automatic flush cycle, then shut off. When the stop switch 66 is momentarily pressed, the auxiliary relay coil ARC is de-energized, thereby reversing all of the associated contacts. As the auxiliary relay contacts AR-1 close, and the contacts AR-2 open, the delay period of the time delay relay TD is begun. The time delayed contacts TD-1 will not open to de-energize the main relay coil MRC until the end of the delay period. The closing of the contacts AR-6 and the opening of the contacts AR-5 cause the valve actuator motor 72 to open the water valve 12 and close the mud valve 14 to the mud pump 10. Therefore, during the delay period the mud pump 10 pumps water into the mud barrel, still driven by the motor 18. The stop button 66 may be released immediately, as the contacts AR-3 open to break the maintaining circuit around the start switch 64.

When the predetermined delay necessary for a complete flushing has been accomplished, the delay relay contacts TD-1 open, thereby de-energizing the main relay coil MRC, opening the main relay contacts MR-1, MR-2, and MR-3, and de-energizing the motor 18.

In the event that the current sensing anti-clogging relay ACR senses an overload and trips as the mud barrel begins to clog up, the anti-clogging relay contacts ACR-1 open. As these contacts ACR-1 are in series with the auxiliary relay coil ARC, the effect is the same as de-energizing the auxiliary relay ARC by pressing the stop button 66 and the automatic flushing cycle begins.

As a safety feature, an emergency motor stop switch 70 is provided in series with the main relay coil 22. Opening the switch 70 will immediately de-energize the main relay coil 22, and thus the motor 18, without a delay for an automatic flushing cycle. If the motor 18 is to remain stopped, the emergency switch 70 must be held open until the time delay relay TD has timed out and opened the contacts TD-1.

Although the invention has been described in terms of specified embodiments which are set forth in detail, it should be understood that it is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. In a drilling mud separator system having a rotatable separator means, power means to rotate said separator means, pumping means for water or mud, and valve means for selectively directing mud or water to said separator, the improvement comprising: electrically operated means for actuating said valve means; a main relay having normally open contacts controlling application of power to said power means; means for energizing said main relay including a normally opened start switch, a series connected normally closed stop switch, and a time delay relay having a pair of contacts connected in series with said main relay; means responsive to closing of said switch for energizing said time delay relay to close said time delay contacts and bypass said start switch; means responsive to opening of said stop switch for de-energizing said time delay relay to delay de-energization of said main relay for a preselected delay period, said means responsive to opening also effecting the operation of said valve actuating means to direct water to said separator and interrupt the flow of mud to said separator to assure cleaning of the separator during said preselected time delay period.

2. The improvement defined in claim 1 wherein said last means responsive to opening comprises an auxiliary relay having its energizing coil connected in series with said start and stop switch contacts, said auxiliary relay having one set of contacts disposed in bypassing relationship to said start switch, a second set of contacts for effecting the de-energization or effecting the energization of said time delay relay, and a third set of contacts effecting the operation of said electrically operated valve means.

3. The improvement defined in claim 1 or 2 wherein normally closed contacts of a manually operable emergency switch are inserted in series relationship with the energizing coil of said main relay.

4. The combination defined in claim 2 wherein a current responsive overload detector relay is inserted in the supply lines to said separator power means, said current responsive relay having normally closed contacts disposed in series with said auxiliary relay contacts bypassing said start switch.

* * * * *